US005863887A

United States Patent [19]

Gillette

[11] Patent Number: 5,863,887

[45] Date of Patent: Jan. 26, 1999

[54] LAUNDRY COMPOSITIONS HAVING ANTISTATIC AND FABRIC SOFTENING PROPERTIES, AND LAUNDRY DETERGENT SHEETS CONTAINING THE SAME

[75] Inventor: Samuel Mark Gillette, Burlington, N.C.

[73] Assignee: Precision Fabrics Group, Inc., Greensboro, N.C.

[21] Appl. No.: 982,310

[22] Filed: Dec. 1, 1997

[51] Int. Cl.[6] ..... C11D 1/65

[52] U.S. Cl. ..... 510/520; 510/499; 510/496; 510/504

[58] Field of Search ..... 510/520, 499, 510/504, 496

[56] References Cited

U.S. PATENT DOCUMENTS

| | | | |
|---|---|---|---|
| Re. 33,646 | 7/1991 | Klemm et al. | 252/90 |
| 3,703,772 | 11/1972 | McHugh et al. | 34/9 |
| 3,893,840 | 7/1975 | Wason | 106/288 B |
| 3,925,224 | 12/1975 | Winston | 252/89 |
| 3,936,537 | 2/1976 | Baskerville, Jr. et al. | 427/242 |
| 4,058,489 | 11/1977 | Hellsten | 252/547 |
| 4,062,647 | 12/1977 | Storm et al. | 8/137 |
| 4,067,746 | 1/1978 | Wason et al. | 106/288 B |
| 4,115,292 | 9/1978 | Richardson et al. | 252/90 |
| 4,118,327 | 10/1978 | Seugnet | 252/8.8 |
| 4,132,806 | 1/1979 | Wason | 424/357 |
| 4,156,717 | 5/1979 | Wason | 424/49 |
| 4,170,565 | 10/1979 | Flesher et al. | 252/93 |
| 4,199,464 | 4/1980 | Cambre | 252/91 |
| 4,199,465 | 4/1980 | Rodriguez | 252/91 |
| 4,255,294 | 3/1981 | Rudy et al. | 252/524 |
| 4,321,157 | 3/1982 | Harris et al. | 252/174.25 |
| 4,375,416 | 3/1983 | Crisp et al. | 252/8.7 |
| 4,561,993 | 12/1985 | Choy et al. | 252/174.25 |
| 4,713,194 | 12/1987 | Gosselink | 252/174.23 |
| 4,861,502 | 8/1989 | Caswell | 252/8.75 |
| 4,876,023 | 10/1989 | Dickenson et al. | 252/90 |
| 4,886,615 | 12/1989 | Dehan | 252/90 |
| 4,891,143 | 1/1990 | Woodward et al. | 252/8.75 |
| 4,913,828 | 4/1990 | Caswell et al. | 252/88 |
| 4,915,854 | 4/1990 | Mao et al. | 252/8.8 |
| 4,931,200 | 6/1990 | Shanklin et al. | 252/91 |
| 5,019,280 | 5/1991 | Caswell et al. | 252/8.8 |
| 5,258,141 | 11/1993 | Crump et al. | 252/546 |
| 5,264,142 | 11/1993 | Hessel et al. | 252/95 |
| 5,358,647 | 10/1994 | Puentes-Bravo et al. | 252/8.6 |
| 5,362,412 | 11/1994 | Hartman et al. | 252/94 |
| 5,472,455 | 12/1995 | Mehreteab et al. | 8/137 |
| 5,494,488 | 2/1996 | Arnoldi et al. | 8/137 |
| 5,494,599 | 2/1996 | Goovaerts et al. | 252/89.1 |
| 5,496,486 | 3/1996 | Staley | 252/89.1 |
| 5,501,814 | 3/1996 | Engelskirchen et al. | 252/174.17 |
| 5,510,042 | 4/1996 | Hartman et al. | 252/8.8 |
| 5,518,645 | 5/1996 | Beaujean et al. | 252/108 |
| 5,545,352 | 8/1996 | Pike | 510/514 |
| 5,616,277 | 4/1997 | Raleigh et al. | 510/220 |
| 5,622,925 | 4/1997 | de Buzzaccarini et al. | 510/329 |
| 5,635,467 | 6/1997 | Staley | 510/349 |
| 5,646,101 | 7/1997 | MacBeath | 510/220 |
| 5,654,265 | 8/1997 | Kuroda et al. | 510/507 |

FOREIGN PATENT DOCUMENTS 818 419 7/1969 Canada .

OTHER PUBLICATIONS

Raymond Getty et al., "Silicates as Corrosion Inhibitors in Synthetic Detergent Mixtures", *ASTM Bulletin,* No. 205, pp. 3–12 (Apr. 1955).

Britesil Hydrous Polysilicates, *the PQ Corporation,* Bulletin 17–107, pp. 1–8.

PQ Soluble Silicates: For Protection of Water Systems From Corrosion, *The PQ Corporation,* Bulletin 37–3, pp. 1–10.

PQ Sodium Silicates: Liquids & Solids, Versatile Products, Versatile Applications, *The PQ Corporation.*

*Primary Examiner*—Paul Lieberman
*Assistant Examiner*—John R. Hardee
*Attorney, Agent, or Firm*—Finnegan, Henderson, Farabow, Garrett & Dunner, L.L.P.

[57] ABSTRACT

A complex of a tertiary amine is disclosed that has antistatic and/or fabric softening properties for laundry use. Also disclosed are several laundry detergent compositions containing these complexes, and a laundry sheet which is a substrate having the complexes and/or compositions applied thereto.

25 Claims, 1 Drawing Sheet

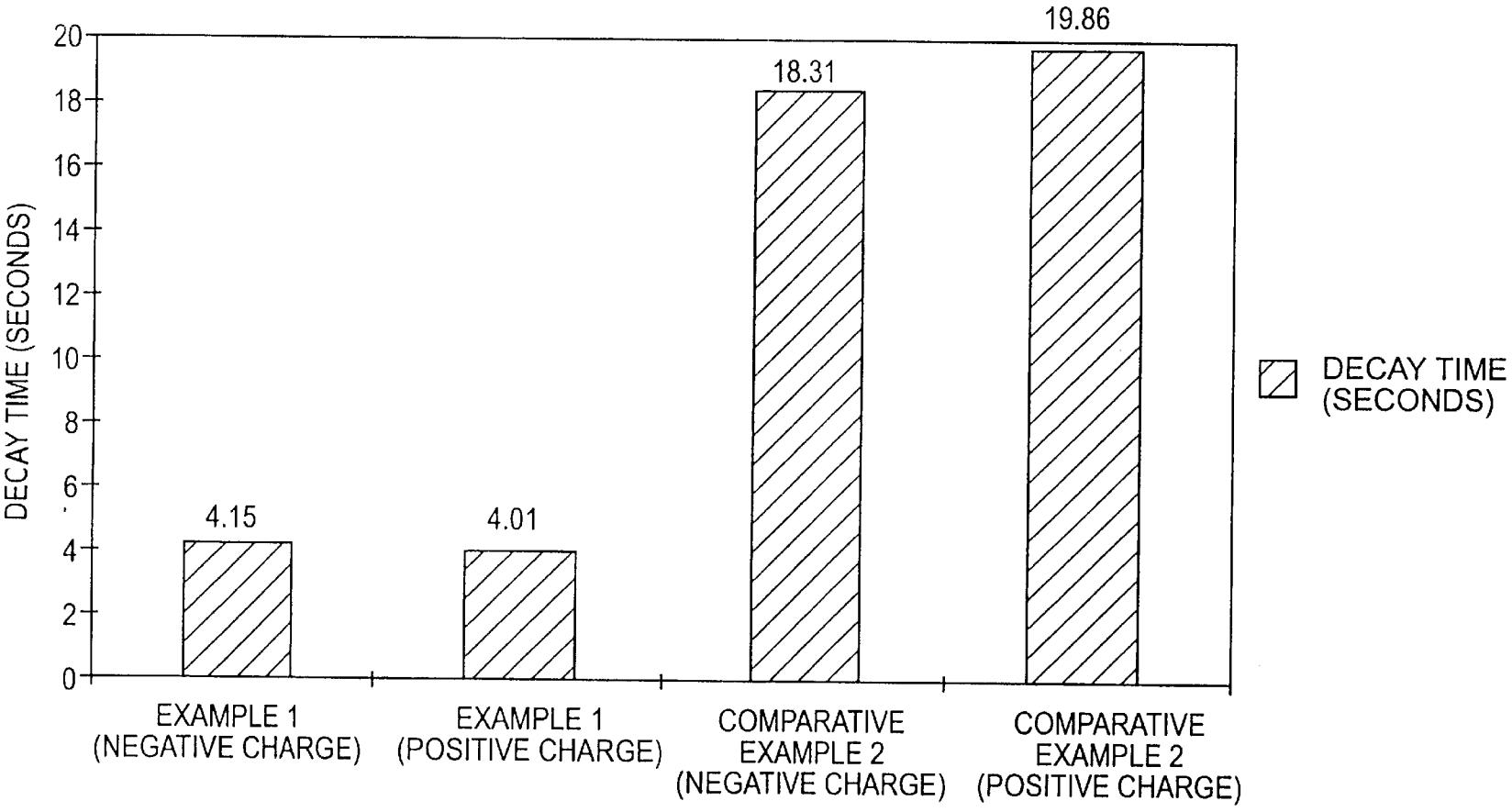
DECAY TIME (SECONDS)
DECAY TIME (SECONDS)
20
18
16
14
12
10
8
6
4
2
0
4.15
4.01
18.31
19.86
EXAMPLE 1 (NEGATIVE CHARGE)
EXAMPLE 1 (POSITIVE CHARGE)
COMPARATIVE EXAMPLE 2 (NEGATIVE CHARGE)
COMPARATIVE EXAMPLE 2 (POSITIVE CHARGE)

LAUNDRY COMPOSITIONS HAVING ANTISTATIC AND FABRIC SOFTENING PROPERTIES, AND LAUNDRY DETERGENT SHEETS CONTAINING THE SAME

BACKGROUND OF THE INVENTION

The present invention relates to laundry products. More particularly, the present invention relates to compositions for laundry use and laundry sheets containing these compositions.

Laundry detergents are commonly dispensed into washing machines by measuring various amounts of liquid or powder detergents into cups or other measuring devices. This is inconvenient and wastes the consumer's time to have to measure out the correct amount of detergent for each load of laundry. Furthermore, when such liquid or powder detergents are measured out into cups or other measuring devices, there exists a common problem of spillage of detergents around the washing machine.

One attempt to overcome the disadvantages of measuring out detergents includes the use of a detergent pouch which is held together with a water soluble adhesive. In theory, the pouch is supposed to become unglued in the wash water and release detergent chemicals into the washing machine. However, the detergent chemicals in the pouch sometimes form clumps which do not break or solubilize to release detergent into the wash water. Also, residual detergent chemicals may remain on the clothes if the detergent in the pouch forms insoluble clumps.

Another attempt in overcoming the problems of measuring detergents from containers has been the use of tablets containing laundry detergent. These tablets have the drawback of limited solubility in the wash water due to the low surface area for solubilization.

Several attempts have also been made to develop acceptable laundry products having the detergent composition impregnated onto a soluble or insoluble fabric sheet. These laundry products desirably are dry to the touch, or in other words, have a "dry hand." At the same time, however, these products should have sufficient detergency, antistatic, and fabric softening properties, while also having a structure and composition simple enough to allow for simple and efficient production of the laundry product.

U.S. Pat. No. 4,095,946 discloses a laundry article having a water soluble surface active agent, a quaternary ammonium fabric conditioning compound, and a dispersion inhibitor, wherein these components are carried on a water insoluble substrate. However, the quaternary ammonium fabric conditioning compounds used in the '946 patent may undesirably react with other components typically used in detergent compositions, may produce an inferior product, and may require complicated production methods.

U.S. Pat. No. 4,915,854 broadly discloses conditioning agents containing amine-anionic ion pair complexes. These complexes do not have ethoxylated groups attached to the nitrogen atom. Additionally, there is no particular advantage disclosed regarding application of these complexes to substrates, particularly single sheet substrates having no binder or adhesive.

Accordingly, there is a need for an antistatic or fabric softening composition that will overcome problems previously encountered. In particular, a need exists for an antistatic or fabric softening composition that can be applied to a substrate and/or combined with detergent components to produce products having acceptable detergency properties, antistatic properties, and fabric softening properties. There is also a need for laundry sheet products that are relatively simple to manufacture and have a dry hand.

SUMMARY OF THE INVENTION

An object of the present invention is to provide an antistatic or fabric softener composition, also known as a fabric conditioning composition, having acceptable antistatic or fabric softening properties.

Another object of the present invention is to provide an antistatic or fabric softener composition having minimal reactivity with detergent components.

Another object of the present invention is to provide a laundry sheet which includes an antistatic agent or fabric softener.

Another object of the present invention is to provide a laundry sheet containing a predetermined amount of a laundry detergent and an antistatic agent or fabric softener which will permit the consumer to simply add the laundry sheet to the washing machine and add additional sheets for larger loads or for loads that the consumer expects will be difficult to clean into the washing machine.

Another object of the present invention is to provide a laundry sheet that allows dissolution or dispersion of the laundry detergent chemicals off of the sheet within the first two minutes in the wash water and that does not allow insoluble or undispersed macroscopic detergent chemical particles to remain in the washing machine at the end of the wash cycle.

Another object of the current invention is to provide a laundry sheet with an observable but controlled amount of foam in the washing machine that makes the laundry detergent sheet ideal for use in front loading washing machines.

Another object of the present invention is to provide an environmentally friendly detergent system which will preferably avoid the use of powdered detergents that incorporate fillers to make them flowable.

Another object of the present invention is to provide a laundry sheet that preferably can be recycled and which avoids the use of fillers which must be processed by waste treatment plants and landfills.

Additional advantages of the present invention will be set forth in part in the description which follows, and in part will be apparent from the description, or may be learned by the practice of the present invention.

To achieve these and other advantages and in accordance with the purpose of the present invention, as embodied and broadly described herein, the present invention relates to a composition containing a complex of the formula I:

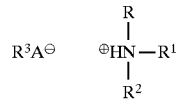

(I)

in an amount effective to provide antistatic and/or fabric softening properties to textiles when placed in contact with the textiles, wherein R is a $C_{12}$–$C_{20}$ alkyl or alkenyl;

$R^1$ is

—$(CH_2CH_2O)_x$—$R^{10}$ in which $R^{10}$ is hydrogen, a branched or linear $C_1$–$C_{10}$ alkyl group, or a branched or linear $C_2$–$C_{10}$ alkenyl group, and x is 1–20, or a $C_{12}$–$C_{20}$ alkyl or alkenyl;

$R^2$ is

—$(CH_2CH_2O)_y$—$R^{10}$ in which $R^{10}$ is hydrogen, a branched or linear $C_1$–$C_{10}$ alkyl group, or a branched or linear $C_2$–$C_{10}$ alkenyl group, and y is 1–20, or a $C_{12}$–$C_{20}$ alkyl or alkenyl;

$A^{\ominus}$ is an anion which is a sulfonate, sulfate, carboxylate, or phosphate; and $R^3$ is —$(OCH_2CH_2)_nO$—$R^{11}$ in which $R^{11}$ may be a branched or linear $C_1$–$C_{20}$ alkyl group, or a branched or linear $C_2$–$C_{20}$ alkenyl group, and n is 1–20;

with the proviso that both $R^1$ and $R^2$ cannot be a $C_{12}$–$C_{20}$ alkyl or alkenyl group.

The present invention further relates to a laundry sheet including a water soluble or water insoluble substrate; and a composition which contains a complex of the formula I above, wherein the composition is applied to the substrate in an amount effective to provide antistatic and/or fabric softening properties to textiles when placed in contact with the textiles.

It is to be understood that both the foregoing general description and the following detailed description are exemplary and explanatory only and are not restrictive of the present invention, as claimed.

BRIEF DESCRIPTION OF FIGURES

FIG. 1 is a graph showing data comparing antistatic properties of test fabrics washed with compositions of the present invention and compositions containing quaternary ammonium compounds. A sheet having a lower decay time has superior antistatic properties.

DETAILED DESCRIPTION OF THE INVENTION

The present invention addresses several problems experienced in the prior art by using specific complexes as antistatic or fabric softening agents. The inventors have found that complexes of an ethoxylated amine and an ethoxylated sulfonic acid are effective antistatic agents and/or fabric softeners. Use of these complexes avoids problems associated with typical quaternary ammonium compounds and quaternary ammonium complexes that are tacky, greasy, or wet to the touch. This characteristic of quaternary ammonium compounds has disadvantages in two respects. First, when applying compositions containing these compounds to substrates to produce a laundry sheet for consumer use, the resulting sheet may have a wet hand. Accordingly, special processing steps may be required, such as applying other components to the substrate in separate steps. Second, the quaternary ammonium compounds may make deposits on the processing equipment used to apply the compositions to the substrates. It may then be necessary to periodically clean the processing equipment, thereby hindering the efficient production of the product.

Quaternary ammonium compounds may also interact with anionic surfactants and polymeric organic builders such as polyacrylates that are desirably used in laundry products to impart cleaning power and a dry hand to the product. This interaction may form insoluble products that contribute to soil redeposition on laundered fabrics. Consequently, products having both quaternary ammonium compounds and anionic surfactants tend to have inferior properties.

One embodiment of the present invention therefore relates to the use of tertiary amine complexes as antistatic agents or fabric softeners. Such complexes may have the structure as shown in formula I above, wherein R is a $C_{12}$–$C_{20}$ alkyl or alkenyl;

$R^1$ is

—$(CH_2CH_2O)_x$—$R^{10}$ in which $R^{10}$ is hydrogen, a branched or linear $C_1$–$C_{10}$ alkyl group, or a branched or linear $C_2$–$C_{10}$ alkenyl group, and x is 1–20, or a $C_{12}$–$C_{20}$ alkyl or alkenyl;

$R^2$ is

—$(CH_2CH_2O)_y$—$R^{10}$ in which $R^{10}$ is hydrogen, a branched or linear $C_1$–$C_{10}$ alkyl group or a branched or linear $C_2$–$C_{10}$ alkenyl group, and y is 1–20, or a $C_{12}$–$C_{20}$ alkyl or alkenyl;

$A^{\ominus}$ is an anion which is a sulfonate, sulfate, carboxylate, or phosphate; and $R^3$ is —$(OCH_2CH_2)_nO$—$R^{11}$ in which $R^{11}$ may be a branched or linear $C_1$–$C_{20}$ alkyl group, or a branched or linear $C_2$–$C_{20}$ alkenyl group, and n is 1–20;

with the proviso that both $R^1$ and $R^2$ cannot be a $C_{12}$–$C_{20}$ alkyl or alkenyl group.

The variables x and y may each preferably be 1–10.

Preferred complexes include those having a structure of the formula I wherein

R is a $C_{12}$–$C_{20}$ alkyl;

$R^1$ is

—$(CH_2CH_2O)_x$—$R^{10}$ in which $R^{10}$ is hydrogen;

$R^2$ is

—$(CH_2CH_2O)_y$—$R^{10}$ in which $R^{10}$ is hydrogen and x+y is 2 to 15;

$A^{\ominus}$ is a sulfonate;

$R^3$is —$(OCH_2CH_2)_nO$—$R^{11}$ in which $R^{11}$ may be a branched or linear $C_{10}$–$C_{20}$ alkyl group, or a branched or linear $C_{10}$–$C_{20}$ alkenyl group, and n is 1–10.

More preferred complexes include those of the formula I wherein

R is a $C_{12}$–$C_{20}$ alkyl;

$R^1$ is

—$(CH_2CH_2O)_x$—$R^{10}$ in which $R^{10}$ is hydrogen;

$R^2$ is

—$(CH_2CH_2O)_y$—$R^{10}$ in which $R^{10}$ is hydrogen and x+y equals 2 to 15;

$A^{\ominus}$ is a sulfonate;

$R^3$ is —$(OCH_2CH_2)_nO$—$R^{11}$ in which $R^{11}$ may be a branched or linear $C_{10}$–$C_{20}$ alkyl group, or a branched or linear $C_2$–$C_{20}$ alkenyl group, and n is 2–5.

Preferred complexes that may be used within the claimed invention are sold by Stepan Co. under the trade names STEOL TMS-2, STEOL TAAS-5, STEOL TAAS-8, and STEOL TAAS-15. Each number in the tradename describes the total average number of ETHOXY groups in $R^1$ and $R^2$ of formula I. These complexes have the following characteristics:

TABLE 1

| | TAAS-2 | TAAS-5 | TAAS-8 | TAAS-15 |
|---|---|---|---|---|
| Appearance @ 25° C. | Paste | Amber Paste | Clear Liquid | Clear Liquid |
| Activity, % | 100 | 100 | 100 | 100 |
| Specific Gravity @ 25° C. | — | 1.00 | 1.035 | 1.05 |
| Density @ 25° C., lbs/gal | — | 8.34 | 8.63 | 8.75 |
| Color, Gardener | 8 | 9 | 8 | 8 |
| Smoke Point, COC, °C. | 132 | 132 | 130 | 142 |
| Volatility, Open Pan % Loss, 1 hr., 0.5 g @ 160° C. | — | 4.14 | 4.48 | 6.69 |
| pH, 5% Aqueous | 6.0 | 6.1 | 6.1 | 5.9 |

TABLE 1-continued

| | TAAS-2 | TAAS-5 | TAAS-8 | TAAS-15 |
|---|---|---|---|---|
| Viscosity c5t | | | | |
| @ 25° C. | Paste | Paste | 1239 | — |
| @ 40° C. | Paste | Paste | 487 | 272 |
| @ 100° C. | — | 54 | 47 | 33 |
| Pour Point, °C. | — | 21.1 | 13.9 | 8.9 |

A composition embraced by the invention therefore comprises an effective amount of the above-mentioned complexes to provide antistatic or fabric softening properties to textiles when the composition is placed in contact with the textiles. Such textiles include laundered fabrics, but may also include woven and nonwoven webs. A preferred amount of the complex present may range from about 0.5 to about 15 wt %. More preferably, the complex is present in the composition from about 1 to about 5 wt %.

The composition may also contain components to provide cleaning, whitening, brightening, and freshening to laundered textiles. Preferably, the composition includes at least a primary surfactant that has good detergency in all temperatures of wash water and in all water hardness conditions, such as a nonionic surfactant. When applied to a substrate to produce a laundry sheet for consumer use, the combination of surfactants and other materials used should preferably dry down to a coating which adheres to the substrate and does not flake off or rub off. Also, surfactants which have a dry finish upon drying on the substrate are preferred over those that leave a wet finish.

It is preferred that besides the primary surfactant, one or more nonionic surfactants such as alcohol ethoxylates can also be included. Four preferred nonionic surfactants are linear primary $C_{12}$–$C_{15}$ alcohol 9-nonylethoxylate, e.g., NEODOL 25-9 (Shell Chemical Co.), $C_{11}$–$C_{15}$ secondary alcohol etjpxylate, e.g., TERGITOL 15-S-9 (Union Carbide), alkyl polyglycosides such as GLUCAPON 225 (Henkel) and ethylene oxide/propylene oxide block copolymers such as PLURONIC F77 (BASF). Substitutes for these preferred nonionic surfactants include, but are not limited to other alcohol ethoxylates such as SURFONIC L-24-9 (Texaco Chemical Co.), also known as $C_{12}$–$C_{14}$-pareth-8.2, SURFONIC N-95 (Texaco Chemical Co.), also known as nonoxynol-10, IGEPAL CO-630 (Rhone-Poulenc), also known as nonoxynol-9. NEODOL 25-9 is preferred of all of these nonionic surfactants because of its good biodegradability.

Generally, the amount of the primary surfactant included is an amount that is sufficient to remove the soil and stains from clothing. A preferred amount is from about 1% to about 80% by weight and more preferably from about 5% to about 40% by weight of the detergent formulation. If the acid form of the surfactant is used for economic reasons, generally, enough sodium hydroxide or other base is added to neutralize the acid. Preferably, a 50% sodium hydroxide solution is used in a sufficient amount to neutralize the acid form of the surfactant.

In situations where the primary surfactant by itself or with an optional builder present is not effective due to excessively cold or hard water, additional nonionic, anionic, or amphoteric surfactants can optionally be added to the composition in an amount sufficient to augment the detergency of the primary surfactant(s). Nonionic, anionic, and amphoteric surfactants suitable for this application include, but are not limited to, alcohol ethoxylates, alkyl phenol ethoxylates, ethylene oxide/propylene oxide block copolymers, alkyl polyglycosides, alkanolamides, amine ethoxylates, amine oxides, and the like. A preferred amphoteric surfactant is cocoamphocarboxydipropionate e.g., MONATERIC CEM-38 (Mona Industries).

A preferred primary surfactant that is anionic for purposes of the present invention is alkylated sulfonated diphenyl oxide-disodium salt, commercially available as DOWFAX Detergent Solution (Dow Chemical Co.), which has the ability to dry down to a powder and is suitable for hard water detergency. Another preferred primary surfactant is tetrasodium N-(1,2-dicarboxyethyl)-N-octadecyl sulfosuccinamate, e.g., AEROSOL 22 (Cytec Industries, Inc.).

Another anionic surfactant is a sodium salt of dodecylbenzenesulfonic acid (DDBSA) which may be purchased commercially. Alternatively, the acid form of DDBSA can be neutralized with sodium hydroxide to form the sodium salt of DDBSA. This surfactant is available under the tradename BIO-SOFT S-100 (Stepan Co., Northfield, Ill.) and substitutes include, but are not limited to, CALSOFT LAS-99 (Pilot Chemical Co.), CAROSULF UL-100 (Lonza Inc.), and WITCO 1298 Acid (WITCO Chemical Co.). BIO-SOFT Preblend is a 46% solution of neutralized DDBSA. Other examples include, but are not limited to, sulfates and sulfonates of ethoxylated alcohols, linear alkyl benzene sulfonates, alcohol sulfates, sodium or potassium salts of long chain fatty acids, carboxylic soaps (e.g., $C_{10}$–$C_{22}$ types), secondary alkane sulfonates, α-olefin sulfonates, methylester sulfonates, and the like.

If a nonionic surfactant is also included, generally an amount is added to the composition to permit the overall composition to remove soil and stains sufficiently in cold water. Preferably, from about 0 to about 70%, more preferably from about 1% to about 40%, of one or more of the nonionic surfactants by weight of the composition can be included.

The following additional components can be also included in the composition in any combination. In general, these additional components are builders, complexing agents, optical brighteners, oxidizing agents, alkaline sources, electrolytes, foam stabilizers, fragrances, color enhancers, biocides, corrosion inhibitors, soil anti-redeposition agents, encrustation preventors, oxidizing agents, and enzymes. Any one or more of these components can be present and examples of each of these components are known to those skilled in the art.

With regard to builders and complexing agents, any builder is suitable for use in the composition of the present invention such as borates, phosphates, polyphosphates, silicates, carbonates, citrates, ethylenediamine tetraacetates, nitrilotriacetates, and the like. Sodium alumina silicate zeolites, such as VALFOR 100 (PQ Corporation), may also be used because of their commercial acceptance in the market and availability in small particle sizes. Builders that can be dried down to a solid and/or can remove divalent and/or polyvalent ions from the wash water, especially iron, copper, calcium, and magnesium, are preferred for inclusion in the detergent composition of the present invention. Further, builders that work by chelation, ion exchange, or precipitation are suitable for use in the present invention. Generally, if a builder is included in the detergent composition of the present invention, an effective amount is included to remove a portion of at least one divalent or polyvalent ion from wash water. Preferred amounts of the builder are from about 0% to about 60% by weight of the detergent composition, more preferably from about 10% to about 40% by weight of the detergent formulation.

Another optional component is an optical brightener which can be added to the composition of the present invention. Generally, any optical brightener can be included in the composition. The optical brightener should preferably take ultraviolet light and shift its wavelength to light in the visible spectrum. Further, optical brighteners should not hinder detergency, yellow the fabric, or cause any other negative effects such as odor or health concerns. Preferably, the optical brighteners contain bistriazinylaminostilbene for brightening of cellulosics and an additional optical brightener for brightening lower surface energy synthetics. Optical brighteners which can be used to brighten cellulosics include, but are not limited to, BLANKOPHOR BBH (Burlington Chemical Co.) (fluorescent brightener 113) and TINOPAL 5BM-GX (Ciba Co.) (fluorescent brightener 28). Substitutes for the BLANKOPHOR BBH include PHORWITE BA (Miles Co.) (fluorescent brightener 113) and RYLUX BA (Ostacolor A.S.) (fluorescent brightener 113). Substitutes for TINOPAL 5BM-GX include PHOTINE C (Miles) (fluorescent brightener 28) and VIOPHOS BCU (Viochron S.A.) (fluorescent brightener 28). TINOPAL SWN (fluorescent brightener 140) and BLANKOPHOR SOL (fluorescent brightener 61) can also be used to achieve the brightening of synthetic fibers as well as RANIPAL SWN (Indian Dystuff Ind. Ltd.) (fluorescent brightener 140) and RYLUX BCU (fluorescent brightener 140). Generally, the amount of optical brightener, if included in the detergent formulation, is an effective amount to brighten the washed clothing. Preferably, from about 0.005% to about 5% by weight of the composition can be included.

When the composition is applied to a substrate to form a laundry sheet, the sequential application of the composition in more than one layer may advantageously separate ingredients in the composition that otherwise would degrade each other. For example, proteases are known to degrade other enzymes such as lipases (e.g. lipolase from Novo Nordisk), amylases (e.g. TERMAMYL or DURAMYL also from Novo Nordisk), and cellulases (e.g. CELLUZYME from Novo Nordisk). Thus, proteases (such as SAVINASE or EVERLASE from Novo Nordisk) may be applied to one side of the sheet and other enzymes to the opposite side of the sheet. As another example, bleach activators such as those described in U.S. Pat. No. 4,483,778 may be separated from peroxygen bleaches to prevent premature degradation of the bleach.

The enzymes, bleaches, and bleach activators described above are preferably released into the wash at the beginning of the wash cycle. Thus, when making a laundry sheet, these ingredients may be applied to a substrate after the application of other components of the composition. The resulting laundry sheet product would then have these ingredients on either its front or back surface to allow rapid dissolution, to allow the ingredients to be separated from the previously coated detergent chemicals so as to reduce deleterious interactions between the ingredients, and to allow for application using different processes (including the printing of patterns). Application of various components or ingredients as sequential layers on the substrate may also allow drying temperatures to be specifically tailored to the characteristics of each layer.

The ingredients preferably used in outer layers of the laundry sheet may be any ingredients that are known in the art as a detergent chemical or as a detergent auxiliary. For example, polyvinyl pyrrolidone (SOKALAN HP 53 from BASF) which is known to be a dye scavenging and soil antiredeposition agent can be printed onto the surface of this sheet. Also, color may be added to the ingredients of subsequent layers that are printed, gravure coated, kiss coated, knife coated, sprayed or otherwise applied. Furthermore, these subsequent layers may be applied in patterns and logos to produce aesthetically pleasing results and to allow for rapid dissolution of previously applied layers should subsequent coatings be less soluble than earlier coatings. Subsequent layers may also be useful for preventing skin contact with previous layers which contain enzymes. Types of bleaches that may find utility in this coating include but are not limited to perborates, percarbonates, hypohalites, and peroxoic acids.

Other ingredients that may be used in a second or subsequent coating on the detergent sheet include builders, nonionic surfactants, polyethylene glycols, polyethylene oxide/polypropylene oxide block copolymers and all types of soil antiredeposition agents. These ingredients would preferably act as carriers for enzymes in powder or liquid form, enzyme stabilizers, protease inhibitors, bleaches, colorants, bleach activators, thickeners and other process aids. The carrier ingredients would preferably be water soluble, water dispersible or have a melting point between 25° C. and 45° C., more preferably between 30° C. and 40° C. Furthermore, it is desirable that the carrier ingredients contribute to a dry hand on the sheet.

The use of borax as a stabilizer for enzymes in combination with the complexes may also increase the shelf life of the enzymes relative to compositions employing quaternary ammonium compounds.

The aforementioned coatings may be applied as aqueous coatings, solvent coatings or as melts which are subsequently cooled. However the coating is applied and however the coating is dried, these processes should not excessively reduce the activity of or degrade the ingredients in the coating. Any coating and drying processes known to those in the art may be used if adequate process controls are maintained. Coating methods used for producing the laundry sheet may involve the use of vacuum extraction, vacuum extraction coupled with heating, and application of the coating in molten form followed by air or contact chilling of the coating for solidification. Various solvents may be used as process aids for this coating. Some suitable solvents include supercritical carbon dioxide, carbon tetrachloride, fluorohydrocarbons, ketones (e.g. acetone and methyl ethyl ketone), ethers (e.g. diethy ether), and alcohols (e.g. methanol, ethanol, propanol etc.). Many solvents besides those listed are expected to be found suitable for this application.

The next optional component that may be used in the composition is an alkaline source to raise the pH of the wash water. While any alkaline source can be used for this purpose, it is preferred that the alkaline source does not contribute any odor to the product and will be dry to the hand when applied to a substrate. A preferred alkaline source is sodium carbonate which also increases the detergency of clay soils, fatty acids, and sebum in the composition. Also, sodium silicates, for instance those sold by PQ Corporation and soil anti-redeposition polymers such as the sodium salts of polymethacrylate or methacrylatemaleic anhydride copolymers, e.g., ACUSOL products (Rohm & Haas), can also contribute to the pH of the wash water. Generally, a sufficient amount of an alkaline source should be added to raise the pH of the composition to a pH of approximately 9 to about 11.5. Preferably the alkaline source may be present from about 1% to about 60% by weight and more preferably from about 5% to about 20% by weight of the composition.

The next optional component that can be included in the composition is an electrolyte which, if chosen well, can also serve as a builder and pH booster. The sodium carbonate referenced above can also serve as an electrolyte which will lower the critical micelle concentration of many surfactants. The presence of additional electrolytes may also allow the surfactants to emulsify some oils and dirt at lower concentrations. Examples of additional electrolytes are sodium silicate and sodium borate. Preferred amounts range from about 1 % to about 60% by weight, more preferably from about 3% to about 50% by weight, of the composition. Depending on formulation constraints, electrolytes such as sodium sulfate may be added to the composition.

Foam stabilizers are an additional component that can be added to the composition. Generally, any foam stabilizer can be used (e.g., amphoterics or anionics) as long as it stabilizes any foam generated by surfactants present in the composition. Preferred foam stabilizers include alkanolamides and amine oxides as well as dioctylsulfosuccinamates. Such foam stabilizers include coconut amides such as ETHOX COA (Piedmont Chemical Industries) or ARMID C (Azko). Preferably, from about 1% to about 30%, more preferably from about 2% to about 6% by weight of the foam stabilizer can be added based on the total weight of the composition.

The next optional component is a fragrance which can be included to mask the odor of the laundry sheets of the present invention and also serve to give the impression to the consumer of freshness. Generally, a sufficient amount of fragrance should only be added to mask the odor of the laundry sheets, and preferably leave a fragrance on the washed clothing. A moderately high molecular weight fragrance which will not appreciably volatilize out of the composition during the production/drying process and which will remain on the clothes to a certain extent is preferred. An example of such a fragrance is perfume oil Downey SUPER 0922 (Value Fragrances, Inc.), or SURF M0513 (Value Fragrances, Inc.), which can be present from about 0% to about 3% by weight of the composition.

A color enhancer can also be included in the composition in small amounts. Preferably, a dye or pigment which imparts a small amount of blue color into the fabrics being washed is preferred. This color enhancer should have solubility properties that permit it to remain level throughout the substrate during the production process without staining fabrics in the washload. A sufficient amount can be included that imparts a slight bluing to the fabrics. A preferred color enhancer is ACID BLUE 145 such as HASTINGS SKY BLUE OB which is an anthraquinone-based dye (Crompton and Knowles). Another preferred colorant is LIQUITINT BLUE HP from Miliken Chemical. A less preferred substitute is ACID BLUE 25 like ALIZARINE BLUE CL (Crompton and Knowles). The color enhancer may be present in an amount from about 0.001% to about 0.5%, more preferably about 0.01 to about 0.025% by weight of the composition. Generally, a dye or pigment which is stable in a highly alkaline environment under high temperatures and for prolonged periods of time is desirable.

Another component that can be present in the composition is a biocide which preserves the composition from attack by microorganisms including bacteria, mildew, and fungus. Preferably, the biocide should be recognized for use in laundry detergents by the United States Environmental Protection Agency, and the biocide should not interact with the surfactant system to minimize the detergency of the surfactants. A preferred biocide is sodium pyrithione, also known as sodium omadine (sodium 2-pyridine thiol-1-oxide).

Another optional component is a corrosion inhibitor which protects surfaces such as metals like zippers, buttons, process equipment, or the inside of washing machines. Preferred corrosion inhibitors include sodium silicate and sodium polysilicate which form a thin inert layer of silicate over the metal surfaces that are susceptible to corrosion. It is preferred that a minimum of about 8 parts per million of sodium silicate or other corrosion inhibitor be present in the wash water. Since sodium silicate is multi-functional and can serve as a builder or a soil anti-redeposition agent, higher levels can be used. In addition to the above preferred corrosion inhibitors, alkanolamides may also serve as corrosion inhibitors. An amount sufficient to prevent the corrosion of metal surfaces should be included and preferred amounts range from about 0% to about 30% by weight, more preferably from about 2% to about 5% by weight based on the total weight of the composition.

The next optional component that can be present is a soil anti-redeposition agent and/or encrustation preventer. Generally, any known soil anti-redeposition agent can be used. Preferably, the soil anti-redeposition agent is a sodium salt of isobutylene/maleic anhydride copolymer such as TAMOL 731A or ACUSOL 460N (Rohm & Haas) or a sodium polymethacrylate such as TAMOL 850. Other examples of sodium polymethacrylates include DARVAN No. 7 (R.T. Anderbilt Co., Inc.) and DAXAD 30 (Hampshire Chemical Co.). In addition, ACUSOL polymers such as ACUSOL 445 (Rohm & Hans) are designed specifically for laundry applications can be used in concentrations as high as 40% by weight of the composition—ACUSOL 445 is a sodium salt of a polyacrylic acid.

Other optional components of the present composition include processing aids such as dispersing agents, thickeners and stabilizers. Many materials that are useful processing aids are also known in the art to be beneficial as soil antiredeposition aids. For example, high molecular weight polyacrylates which are used as thickeners (e.g. Carbopols—B.F. Goodrich) may also be beneficial for detergency. Materials such as carboxymethycellulose, hydroxymethycellulose and polyethylene oxide are known in the art to be thickeners and soil antiredeposition agents. Stabilizers such as ACUSOL 810 and ACUSOL 820 (polyethacrylate copolymers) may be used to allow formulation latitude. For example ACUSOL 810 and 820 provide the latitude to raise the electrolyte concentration of a slurry which in turn can offer detergency benefits.

Preferred examples include ACUSOL 445ND, 810, 820, 460ND, SOKALAN CP2, and SOKALAN CP5, and mixtures thereof. When sodium carbonate is included as an optional component in the composition of the present invention, it is preferred that sufficient amounts of a soil anti-redeposition agent be included to avoid encrustation on the inside of the washing machine. Generally, an amount of the soil anti-redeposition agent is included to prevent soil redeposition and/or encrustation on fabrics. Preferred amounts range from about 0.5% to about 40% by weight, more preferably from about 0.5% to about 4% by weight of the composition.

Another embodiment of the invention relates to a laundry product having the compositions described above applied to a substrate. The substrate can be any substrate known in the art, including, for example, nonwoven and woven fabrics, open-cell rubber or plastic foam sheets, and sheets of cellulose fibers, as long as the substrate is capable of holding the compositions. Examples of substrates can be found in copending U.S. patent application Ser. No. 08/769,391 filed Dec. 19, 1996 pending, the entire contents of which are incorporated herein by the reference. The sheet is preferably a nonwoven fabric. More preferably, the nonwoven fabric sheet is a needlepunched polyester material. It is also preferred that the fabric sheet have a high loft (e.g., a fabric having a basis weight of between about 2 oz/sq. yard to about 6 oz/sq. yard, a mil thickness greater than 40 mils) and fibers fine enough to provide maximum surface area for adhesion of the detergent chemicals and which promote dissolution of the detergent components at the beginning of the wash cycles. The most preferred fabric is a needlepunched polyester produced from 4 denier×4" fibers with a mil thickness of 60 mils and that does not produce lint in the washer or dryer.

In the preferred compositions, the laundry sheet containing the composition is dry to the touch to minimize the transfer of chemicals from the sheet to the user's hands.

Another preferred substrate is a nonwoven fabric that is formed from polyester/rayon fibers and produced by a hydro-entangled process. This fabric sheet may have a thickness of about 15 mils to about 100 mils and a fabric weight of about 2 oz/sq. yard to 6 oz/sq. yard. Further, if the substrate that is used is a polyester or other similar polymer, the sheet can be recycled with other plastic materials such as plastic bottles after being used in a wash cycle. Any nonwoven sheet capable of holding the detergent composition and withstanding the laundering process may be used for this invention. Other fabrics such as spunbonds, powder bonded fabrics, resin bonded fabrics, meltdown fabrics, and thermal bonded fabrics are also useful in this invention. The fabrics can be made of conventional materials, such as acrylics, rayon, cotton, or polypropylene. Preferably, the fabric material should have a melting point above 300° F.

As mentioned, substrates that can be used include open-cell foam rubbers and plastic foams. Urethane foam with a melting point above 300° F. is preferred. Examples of such urethane foams can be found in air filtration products and fabric softener sheets known in the art.

Also, water soluble substrates may also be used so that when the laundry product goes through a wash cycle, the entire product solubilizes leaving no residual product for disposal. These substrates are well known in the art, and include for example, substrates made from polyvinyl alcohols.

Preferably, the compositions described herein are coated onto or impregnated into the substrate by any means known to those skilled in the art. For example, the compositions can be applied to the substrate by means of a water slurry, from a melt, or from a solvent system.

Application of a slurry to the substrate may occur using any device which forces the slurry into the substrate or allows the slurry to flow into the substrate. Examples of application equipment include standard coating equipment, slot applicators, various types of printing equipment, padding equipment, and spraying equipment. The substrate is then carried by a supporting device through a drying device and processed into sheets or wound into rolls. Examples of supporting devices include rollers, belts, and clip and pin frames.

The fabric is unrolled and fed into an on-the-frame knife coater such as a MASCOE 4TC where it is drawn under the coating applicator and over a foam rubber pad. The slurry is held in a trough just in front of the coating knife and is applied to the fabric as it passes underneath. The slurry is both impregnated into and coated onto the fabric in such a way that the coating is fiber reinforced thus reducing the tendency for sloughing off of the compound in downstream handling. The slurry is applied to achieve from 26 to 42 ounces per square yard of wet coating.

Process controls and equipment for fabric conveyance, for fabric guidance and for controlling fabric dimensional characteristics (e.g overfeed, tension, and creasing) should be used as necessary to convey the fabric in a flat and open position under a coating head and through drying, slitting and batching equipment. The fabric is conveyed between a vinyl covered foam pad and a coating trough. Depending on the viscosity of the detergent composition, the curvature of the coating blade, and the frame speed, various process parameters may be adjusted to achieve penetration of the coating through the fabric and the desired wet add on. For example the coating blade may be raised to produce a bigger gap between the foam pad and the coating blade. The depth of compound in the coating trough may be increased to increase the downward pressure of the compound into the fabric. The width of the slot which allows the slurry to meet the fabric may be adjusted, as well as the density of the foam pad. The viscosity of the compound may be lowered by raising the temperature of the slurry.

The substrate can be dried using vacuum extraction, or any type of radiant energy with wavelength longer than ultra violet, or using convection drying. For example, infrared preheaters with a gas fired forced air oven can be used. The fabric is then cut into swatches that allow for the proper amount of the composition to be delivered to the laundry.

In making the compositions, the components can simply be stirred together to produce a homogeneous slurry. The components are preferably added in the order set forth in the tables for ease of processing. Any order of addition is possible if acidic materials are diluted and preneutralized. Once the slurry is formed, in order to apply the slurry to the substrate to make a laundry sheet of the present invention, the slurry is pumped into a coating trough or other application device and impregnated or applied into or on the substrate, preferably a low denier, high loft nonwoven fabric sheet. The substrate is supported in a horizontal and flat position while the water is evaporated from the substrate. The substrate can then be cut into desired shapes and sizes and placed in a box for use by the consumer. The compositions set forth in Table 2 below are preferred because these slurries can be coated and dried on a tenter frame without causing excessive contamination to the winding, coating, and drying equipment. Further, these particular compositions, upon being applied to the substrate are dry to touch and thus do not get the user's hands wet with detergent. It is preferred that the substrate or sheet be a needle punched fabric, but spun laced fabric or foam sheets can also be used.

The laundry product having a substrate may additionally provide cleaning, whitening, brightening, and freshening to laundered articles in the washing machine. The preferred compositions applied to the substrate readily solubilize off the substrate during the washing process.

It is preferred that the above additional components as well as the primary surfactants and nonionic surfactants have a small particle size range. A small particle size range makes it easier for the composition to be applied or impregnated onto the substrate. The particle size range is preferably less than about 200 microns, and more preferably from about 0.1 microns to about 10 microns for each component that is present in the composition.

Set forth below is a table providing a listing of preferred ingredients for the composition with preferred ranges and most preferred ranges based on weight percents of the entire preferred detergent composition. Such compositions are suitable for application to a substrate sheet.

TABLE 2

| Component | Preferred Range (Wt. Percent) | Most Preferred Range (Wt. Percent) |
|---|---|---|
| Water | Balance | Balance |
| ACUSOL 810 | 0–40 | 0.2–4 |
| ACUSOL 820 | 0–40 | 0.2–4 |
| Soda Ash | 0–60 | 2.5–10 |
| DOWFAX Detergent Solution | 0–95 | 15–25 |
| HASTINGS SKY BLUE OB | 0–0.5 | 0.01–0.2 |
| Sodium Omadine (40%) | 0–0.2 | 0.05–0.08 |
| BIO-SOFT Preblend | 0–95 | 5–20 |
| Burcowite BTA - Conc. | 0–10 | 0–5 |
| TERGITOL TMN-6 | 0–40 | 0–2 |
| TERGITOL 15-S-9 | 0–40 | 0–2 |
| NEODOL 25-9 | 0–40 | 5–15 |
| ETHOX COA | 0–30 | 2–6 |
| Downey SUPER 0922 | 0–5 | 0.3–0.7 |
| STEOL TAAS-8 | 0.5–30 | 1–5 |
| TAMOL 850 | 0–40 | 0–5 |
| VALFOR 100 | 0–60 | 0–2.5 |
| Sodium Sulfate | 0–60 | 2.5–10 |
| ACUSOL 460 ND | 0–80 | 0.2–4 |
| ACUSOL 445 ND | 0–80 | 0.5–4 |
| Silicate E | 0–30 | 2–5 |
| Ground Neobor (Borax 5 mol) | 0–50 | 10–20 |

It is preferred to apply the compositions to the substrate from a water slurry. However, applying the compositions from a melt or from a nonaqueous solvent is also possible. The following Table gives the components of a water slurry (low soda ash formula), a melt formula, and a solvent formula.

Preferred compositions used in the water slurry application are shown in the following Tables:

TABLE 3

| INGREDIENT | FORMULA A (Wt. Percent) | FORMULA B (Wt. Percent) |
|---|---|---|
| Water | 22.32 | 20.66 |
| Sodium Sulfate | — | 3 |
| DOWFAX Detergent Solution | 16 | 15 |
| Westvaco Diacid H-240 | — | 10 |
| TAMOL 731A | — | 1 |
| TAMOL 850 | — | 1 |
| VALFOR 100 | — | 27.5 |
| ACUSOL 810 | 0.1 | — |
| ACUSOL 820 | 0.2 | — |
| ACUSOL 445 ND | 1 | 1 |
| ACUSOL 460 ND | 1 | — |
| BIO-SOFT Preblend | 16 | — |
| TERGITOL TMN-6 | 1 | 1 |
| Burcowite BTA-Conc. | 2.1 | 2.1 |
| 7% HASTINGS SKY BLUE OB | — | 0.17 |
| 10% Solution of LIQUITINT BLUE HP | 0.2 | — |
| Sodium Omadine | 0.07 | 0.07 |
| Soda Ash | 7.5 | 1 |
| STEOL TAAS-8 | 3 | 3 |
| NEODOL 25-9 | 9.5 | 12 |
| Downey SUPER 0922 | 0.51 | 0.5 |
| ETHOX COA | 2 | — |
| Silicate 41A | 2 | 1 |

TABLE 3-continued

| INGREDIENT | FORMULA A (Wt. Percent) | FORMULA B (Wt. Percent) |
|---|---|---|
| Borax Technical Powder | 7.5 | — |
| Boron #10 | 8 | — |

TABLE 4

| INGREDIENT | FORMULA C (Wt. Percent) |
|---|---|
| Water | 19.26 |
| ACUSOL 810 | 0.1 |
| ACUSOL 820 | 0.1 |
| ACUSOL 445 N (45% solution of ACUSOL 445 ND) | 2.2 |
| ACUSOL 460 N (25% solution of ACUSOL 460 ND) | 4 |
| DOWFAX Detergent Solution | 16 |
| BIO-SOFT Preblend | 16 |
| 7% HASTINGS SKY BLUE OB | 0.17 |
| TERGITOL TMN-6 | 1 |
| VALFOR 100 | 2 |
| Soda Ash | 7.5 |
| Burcowite BTA-Conc. | 2.1 |
| Sodium Omadine | 0.07 |
| STEOL TAAS-8 | 3 |
| NEODOL 25-9 | 9.5 |
| Downey SUPER 0922 | 0.5 |
| ETHOX COA | 2 |
| Silicate E | 2 |
| NEOBOR (Borax 5 Mol Powdered) | 12.5 |

TABLE 5

| INGREDIENT | FORMULA D (Wt. Percent) |
|---|---|
| Cold Water | 17.26 |
| ACUSOL 810 | 0.1 |
| ACUSOL 820 | 0.1 |
| Soda Ash | 5.5 |
| DOWFAX Detergent Solution | 16 |
| BIO-SOFT Preblend | 16 |
| 7% HASTINGS SKY BLUE OB | 0.17 |
| TERGITOL TMN-6 | 1 |
| VALFOR 100 | 2 |
| Burcowite BTA-Conc. | 2.1 |
| Sodium Omadine | 0.07 |
| STEOL TAAS-8 | 3 |
| NEODOL 25-9 | 9.5 |
| Downey SUPER 0922 | 0.5 |
| ETHOX COA | 2 |
| Silicate E | 2 |
| Ground Neobor (Borax 5 Mol) | 16.5 |
| ACUSOL 445 N (45% solution of ACUSOL 445ND) | 2.2 |
| ACUSOL 460 N (25% solution of ACUSOL 460ND) | 4 |

TABLE 6

| INGREDIENT | FORMULA E (Wt. Percent) | FORMULA F (Wt. Percent) | FORMULA G (Wt. Percent) |
|---|---|---|---|
| Cold Water | 15.46 | 15.46 | 11.96 |
| Soda Ash | 4 | 4 | 3.5 |
| DOWFAX Detergent Solution | 16 | 16 | 16 |
| BIO-SOFT Preblend | 16 | 16 | 16 |
| 7% HASTINGS SKY BLUE OB | 0.17 | 0.17 | 0.17 |
| TERGITOL TMN-6 | 1 | 1 | 1 |
| VALFOR 100 | 2 | 2 | 2 |
| Burcowite BTA -Conc. | 2.1 | 2.1 | 2.1 |
| Sodium Omadine | 0.07 | 0.07 | 0.07 |
| STEOL TAAS-8 | 3 | 3 | 3 |
| NEODOL 25-9 | 9.5 | 9.5 | 9.5 |
| Downey SUPER 0922 | 0.5 | 0.5 | 0.5 |
| ETHOX COA | 2 | 2 | 2 |
| Silicate E | 2 | 2 | 2 |
| Mitted NEOBOR (Borax 5 Mol) | 20 | 20 | 24 |
| ACUSOL 445 N (45% solution of ACUSOL 445 ND) | 2.2 | 2.2 | 2.2 |
| ACUSOL 460 N (25% solution of ACUSOL 460 ND) | 4 | 4 | 4 |
| Special Processing | None | Homogenize | None |

The amount of the composition on a substrate which has the size of approximately 6"×6.5" is preferably at least 2 grams. A more preferred amount is at least 12 grams per 6"×6.5" substrate. Of course, this amount can be adjusted to any desired amount. An even more preferred amount is from about 14 grams to about 18 grams per 6"×6.5" substrate.

The components listed in the above tables may be added to the substrate to form a laundry sheet wherein the ratio of each component on a dry basis in the composition is 1–95 wt % of at least one complex of formula I, 0–95 wt % of at least one builder, 0–95 wt % of at least one surfactant, 0–60 wt % of at least one soil redeposition agent, 0–5 wt % of at least one foam stabilizer, 0–1 wt % of at least one color enhancer, 0–1 wt % of at least one optical brightener, and 0–0.5 wt % of at least one biocide. Preferably, the composition present on the substrate contains, on a dry basis, 1–30 wt % of at least one complex of formula I, 1–95 wt % of at least one builder, 1–95 wt % of at least one surfactant, 1–5 wt % of at least one soil redeposition agent, 1–5 wt % of at least one foam stabilizer, 0.01–0.05 wt % of at least one color enhancer, 0.1–1 wt % of at least one optical brightener, and 0.01–0.05 wt % of at least one biocide.

An example that is illustrative of a process for producing the laundry sheet of the claimed invention is as follows.

EXAMPLE 1

In a clean container equipped with appropriate stirring devices, the components of Formula G were added stepwise to form a composition which was a uniform slurry. The order of ingredients specified in Table 6 is the preferred order of addition. Any powders used in the composition (e.g. builders, fillers, or optical brighteners) which did not solubilize in the slurry were milled to a particle size of preferably less than 10 microns. Alternatively, the slurry may be milled to produce a uniform dispersion of fine particles. If large particles are allowed to remain in the composition it is desirable to continuously stir or recirculate the composition until it is applied to the fabric. The stirring and recirculation may be necessary to prevent settling of the powders and layering of the slurry. The composition was stirred to produce an even and uniform slurry that met the following specifications.

| Test | Range |
|---|---|
| pH(1%) | 8.5–10.5 |
| Solids (oven) | 56.5–58.5% |
| Specific gravity | 1.05–1.25 |
| Brookfield Viscosity | 3,000–20,000 cps |
| Titration of 100 g in 900 ml water 20% acetic | 55–57 grams at pH 7 |
| Color | pantone 297U |
| Fragrance | present |

The slurry was then moved to the finishing facility to be applied to a fabric that was sufficiently strong to allow processing and have durability to laundering. A needlepunched polyester fabric produced from 4 denier×4" fiber; from 50 to 300 mils thick was the substrate. Other types of fabrics or substrates with a surface area and void volume similar to this fabric would produce an acceptable product. The fabric may be held on both selvages by the pin chain of the tenter frame and stretched, if necessary, in the cross-direction. For example, the fabric may be stretched about 10%. The coated fabric was then passed underneath infrared predryers before drying in a gas-fired convection oven at 275–450 degrees Farenheit. The product was then cooled with cool air, trimmed and rolled up for shipment. The finished product conformed to the following specifications:

| | |
|---|---|
| Basis weight overall | 16.15–25.5 OSY |
| Dry add-on | 13.75–23.1 OSY |
| Thickness | 0.060" |
| Width | 60" |
| Wash durability | OK to 1 MW and dry |
| Fragrance | Present after laundering |
| Moisture content | <10% |

As a result of the present invention, a laundry sheet can be made which contains a predetermined dose of detergent chemicals to provide convenience to consumers. In addition, the product in the test load should show little or no static cling, and the sheet should shed little or no fiber into the test load. Preferably the laundry sheet contains no fillers and is a concentrated product with as many multifunctional ingredients as possible. For example, the following ingredients can provide multiple functions.

TABLE 7

| Ingredient | Functions |
|---|---|
| Sodium Aluminosilicate | Builder, Water Softener, Contributes to Dry Hand |
| Soda Ash | Builder, Water Softener, Contributes to Dry Hand, Raises pH for Better Polar Soil Detergency (Alkali Source) |
| Polyacrylates | Soil Anti-Redeposition Agents, Dispersant, Organic Builder |
| Coconut Amine concentrates | Improves Detergency, Produces Foam (Esthetically Pleasing) |
| HASTINGS SKY BLUE OB | Colors Coating, Optical Brightening |
| Sodium Silicate | Corrosion inhibition, Builder, Water Softener, Dry Hand |
| Tertiary Amine Complex | Antistatic Agent, Fabric Softener |

EXAMPLE 2

The polyester needle punch fabric was formed by opening, blending and separating bales of polyester tow. A batt was formed, the fibers realigned, the batt was lapped, fibers were further realigned and the web was punched, stretched, heat set, fused and calendered as necessary. The fabric was then slit and batched into 600 linear yard rolls.

The composition of Formula G was prepared to form a first mixture. This composition contained the tertiary amine complex sold as STEOL TAAS-8. The mixture was then applied to needle punch fabric by coating and dried to form a laundry detergent sheet. The total add-on of the composition to the substrate was 18.74 ounces per square yard.

COMPARATIVE EXAMPLE 2

The following detergent composition containing ETHOQUAD C12 and no STEOL TAAS-8 was prepared by combining the components shown in the following Table, in the order shown.

TABLE 8

| Component | % |
|---|---|
| Water | 45.542 |
| BIO-SOFT S-100 | 7.62 |
| 50% Sodium Hydroxide | 2.03 |
| ACUSOL 445 ND | 0.89 |
| Soda Ash | 3.42 |
| BLANKOPHOR BBH | 0.43 |
| ETHOX COA | 3.27 |
| ETHOQUAD C12 | 2.5 |
| TAMOL 731A | 1.00 |
| TINOPAL SWN | 0.008 |
| SURF M 0513 | 0.51 |
| 6% HASTINGS SKY BLUE OB | 0.17 |
| Sodium Omadine | 0.07 |
| NEODOL 25-9 | 9.16 |
| TERGITOL 15-S-9 | 0.79 |
| TAMOL 850 | 0.89 |
| VALFOR 100 | 19.3 |
| Silicate E | 2.4 |

ETHOQUAD C12 is a quaternary ammonium compound obtained from Akzo Chemicals, Inc.

The BIO-SOFT S-100 was first dissolved in the water before adding the sodium hydroxide. The sodium hydroxide was added to bring the pH to between 8 and 11. The NEODOL 25-9 was added while the mixture was still warm.

This composition was then applied to a laundry sheet in the same manner set forth in Example 1.

EXAMPLE 3

A laundry sheet was prepared according to the process of Example 2 wherein 25.95 grams of Formula G (57.95% solids) were applied to a 6"×6½" sheet and dried as described in Example 2 to give a dry add on of 15 grams on a sheet. A laundry sheet was also produced according to the process of Comparative Example 2, wherein 30.92 grams of Comparative Example 2 formula were also applied to a 6"×6½" sheet and dried to give a dry add-on of 15 grams. Each laundry sheet was placed in a Kenmore Series 80 washing machine set on normal cycle, full water setting, warm wash, cold rinse with 5.5 pounds of ballast composed of 50% of cotton and 50% of polyester. 60×60 cotton sheeting weighing 4.45 ounces per square yard also known as style 493 from Test Fabrics, Inc., Middlesex, N.J. was also placed in the washing machine away from the laundry sheet and the washing machine was started.

The labeled cotton style 493 fabrics were removed from their respective washing machines after the wash was complete and placed in a DESPATCH oven with air circulation and moisture venting at 105° C. for 1 hour. To evaluate the antistatic properties of STEOL TAAS-8 within a composition, the time required for each washed fabric (style 493) to dissipate a charge from its surface was measured according to the method of INDA Standard Test: IST 40.2 (95), the entire contents of which are incorporated herein by reference. The resulting data is shown in FIG. 1. As can be seen from this data, the charge applied to fabrics washed with the laundry sheet of Example 2 dissipated in about 4 seconds, as compared to over 18 seconds for fabrics washed with the laundry sheet of Comparative Example 2. The laundry sheet of Example 2 therefore imparted superior antistatic properties to the wash.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A laundry sheet comprising:

a) a water soluble or water insoluble substrate; and b) a composition which comprises a complex of the formula I

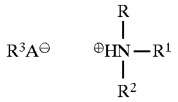

(I)

wherein

R is a $C_{12}$–$C_{20}$ alkyl or alkenyl;

$R^1$ is

—$(CH_2CH_2O)_x$—$R^{10}$ in which $R^{10}$ is hydrogen, a branched or linear $C_1$–$C_{10}$ alkyl group, or a branched or linear $C_2$–$C_{10}$ alkenyl group, and x is 1–20, or a $C_{12}$–$C_{20}$ alkyl or alkenyl;

$R^2$ is

—$(CH_2CH_2O)_y$—$R^{10}$ in which $R^{10}$ is hydrogen, a branched or linear $C_1$–$C_{10}$ alkyl group, or a branched or linear $C_2$–$C_{10}$ alkenyl group, and y is 1–20, or a $C_{12}$–$C_{20}$ alkyl or alkenyl;

$A^{\ominus}$ is an anion which is a sulfonate, sulfate, carboxylate, or phosphate; and $R^3$ is —$(OCH_2CH_2)_n$O—$R^{11}$ in which $R^{11}$ may be a branched or linear $C_1$–$C_{20}$ alkyl group, or a branched or linear $C_2$–$C_{20}$ alkenyl group, and n is 1–20;

with the proviso that both $R^1$ and $R^2$ cannot be a $C_{12}$–$C_{20}$ alkyl or alkenyl group;

wherein the composition is present on the substrate in an amount effective to provide antistatic and/or fabric softening properties to textiles when placed in contact with the textiles.

2. The laundry sheet of claim 1, having a complex of the structure of the formula I, wherein R is a $C_{12}$–$C_{20}$ alkyl;

$R^1$ is

—$(CH_2CH_2O)_x$—$R^{10}$ in which $R^{10}$ is hydrogen;

$R^2$ is

—$(CH_2CH_2O)_y$—$R^{10}$ in which $R^{10}$ is hydrogen and x+y is 2 to 15;

$A^{\ominus}$ is a sulfonate;

$R^3$ is —$(OCH_2CH_2)_n$O—$R^{11}$ in which $R^{11}$ may be a branched or linear $C_{10}$–$C_{20}$ alkyl group, or a branched or linear $C_{10}$–$C_{20}$ alkenyl group, and n is 1–10.

3. The composition of claim 1, having a complex of the structure of formula I, wherein R is a $C_{12}$–$C_{20}$ alkyl;

$R^1$ is

—$(CH_2CH_2O)_x$—$R^{10}$ in which $R^{10}$ is hydrogen;

$R^2$ is

—$(CH_2CH_2O)_y$—$R^{10}$ in which $R^{10}$ is hydrogen and x+y is 2 to 15;

$A^{\ominus}$ is a sulfonate;

$R^3$ is —$(OCH_2CH_2)_n$O—$R^{11}$ in which $R^{11}$ may be a branched or linear $C_{10}$–$C_{20}$ alkyl group, or a branched or linear $C_{10}$–$C_{20}$ alkenyl group, and n is 2 to 5.

4. The composition of claim 1, having a complex of the structure of formula I, wherein R is a tallow group;

$R^1$ is —$(CH_2CH_2O)_x$—H;

$R^2$ is —$(CH_2CH_2O)_y$—H;

wherein x+y is 2 to 15;

$A^{\ominus}$ is a sulfonate; and $R^3$ is —$(OCH_2CH_2)_n$O—$(CH2)_bCH_3$, wherein n is 2 to 5 and b is 10 to 15.

5. The laundry sheet of claim 1, further comprising an organic or inorganic builder, surfactant, complexing agent, optical brightener, alkaline source to raise pH, electrolyte, foam stabilizer, color enhancer, colorant, biocide, corrosion inhibitor, soil anti-redeposition agent, encrustation preventer, oxidizing agent, or an enzyme, or any combination thereof.

6. The laundry sheet of claim 1, further comprising a surfactant and a builder.

7. The laundry sheet of claim 6, wherein said surfactant is a nonionic surfactant.

8. The laundry sheet of claim 6, wherein said surfactant is an anionic surfactant.

9. The laundry sheet of claim 6, wherein said surfactant is an amphoteric surfactant.

10. The laundry sheet of claim 6, wherein said surfactant is an alcohol ethoxy sulfate, a linear alkyl benzene sulfonate, an alcohol sulfate, a sodium or potassium salt of a long chain fatty acid, a secondary alkane sulfonate, an α-olefin sulfonate, a cocoamphocarboxylpropionate, or a methylester sulfonate, or any combination thereof.

11. The laundry sheet of claim 6, wherein said surfactant is at least one nonionic surfactant and at least one anionic surfactant.

12. The laundry sheet of claim 6, wherein said surfactant is an alcohol ethoxylate, an alkylphenol ethoxylate, an ethyleneoxide/propyleneoxide block copolymer, an alkyl polyglycoside, an alkanolamide, an amine ethoxylate, or an amine oxide.

13. The laundry sheet of claim 4, comprising on a dry basis 1–30 wt % of at least one complex of formula I, 1–95 wt % of a at least one builder, 1–95 wt % of at least one surfactant, 0–5 wt % of at least one soil redeposition agent, 0–5 wt % of at least one foam stabilizer, 0–1 wt % of at least one color enhancer, 0–1 wt % of at least one optical brightener, and 0–0.5 wt % of at least one biocide.

14. The laundry sheet of claim 11, wherein the anionic surfactant is an alkylated sulfonated diphenyl oxide disodium salt or a tetrasodium N-(1,2-dicarboxymethyl)-N-octadecyl sulfosuccinamate.

15. The laundry sheet of claim 1, wherein said substrate is a nonwoven sheet.

16. The laundry sheet of claim 1, wherein said substrate is a polyester, nylon, urethane or polypropylene.

17. The laundry sheet of claim 1, wherein said substrate is a needle punch fabric.

18. The laundry sheet of claim 5, wherein said builder is a borate, a phosphate, a polyphosphate, a zeolite, a silicate, a carbonate, a citrate, an ethylenediaminetetracetate, or a nitrilotriacetate, or any combination thereof.

19. The laundry sheet of claim 5, wherein said optical brightener comprises bistriazinyl aminostilbene.

20. The laundry sheet of claim 5, wherein said alkaline source is sodium carbonate, sodium silicate, a polymethacrylate, or a methacrylate maleic anhydride copolymer.

21. The laundry sheet of claim 5, wherein said electrolyte is sodium carbonate.

22. The laundry sheet of claim 5, wherein said foam stabilizer is an alkanolamide, an amine oxide, or a dioctylsulfosuccinamate.

23. The laundry sheet of claim 5, wherein said biocide is sodium omadine.

24. The laundry sheet of claim 5, wherein said corrosion inhibitor is a sodium silicate or a sodium polysilicate.

25. The laundry sheet of claim 5, wherein said soil anti-redeposition agent is an isobutylene/maleic anhydride copolymer sodium salt, sodium polyacrylate, sodium polymaleic acidolefin, sodium polyacrylic acid maleic acid salt, polyvinyl pyrrolidone, or a sodium polymethacrylate.

* * * * *

UNITED STATES PATENT AND TRADEMARK OFFICE

CERTIFICATE OF CORRECTION

PATENT NO. : 5,863,887

DATED : January 26, 1999

INVENTOR(S) : Samuel Mark Gillette

It is certified that error appears in the above-indentified patent and that said Letters Patent is hereby corrected as shown below:

Claim 4, column 19, line 64, "$(CH2)_bCH_3$" should read --$(CH_2)_bCH_3$--.

Claim 13, column 20, line 29, "of a at" should read --of at--.

Signed and Seated this

Fifteenth Day of June, 1999

*Attest:*

*Attesting Officer*

Q. TODD DICKINSON

*Acting Commissioner of Patents and Trademarks*